US007631563B2

(12) United States Patent
Newman

(10) Patent No.: US 7,631,563 B2
(45) Date of Patent: Dec. 15, 2009

(54) METHOD AND SYSTEM FOR EVALUATING ROD BREAKOUT BASED ON TONG PRESSURE DATA

(75) Inventor: Frederic M. Newman, Midland, TX (US)

(73) Assignee: Key Energy Services, Inc., Houston, TX (US)

( * ) Notice: Subject to any disclaimer, the term of this patent is extended or adjusted under 35 U.S.C. 154(b) by 162 days.

(21) Appl. No.: 11/850,405

(22) Filed: Sep. 5, 2007

(65) Prior Publication Data

US 2009/0056467 A1 Mar. 5, 2009

(51) Int. Cl.
*G01L 5/24* (2006.01)

(52) U.S. Cl. ..... 73/862.25

(58) Field of Classification Search ..... 73/152.51, 73/862.21, 862.23–862.25; 166/77.51
See application file for complete search history.

(56) References Cited

U.S. PATENT DOCUMENTS 4,416,147 A * 11/1983 Hasha ..... 73/49.6
4,738,145 A 4/1988 Vincent et al. ..... 73/862.23
4,843,924 A 7/1989 Hauk ..... 81/57.2
6,000,472 A * 12/1999 Albright et al. ..... 166/380
6,056,060 A * 5/2000 Abrahamsen et al. ..... 166/380
7,163,335 B2 * 1/2007 Dishaw et al. ..... 374/4
2001/0000832 A1 5/2001 Newman ..... 29/174
2006/0201258 A1 9/2006 Wandeler et al. ..... 73/861
2007/0089878 A1 4/2007 Newman ..... 166/255.1

* cited by examiner

*Primary Examiner*—John Fitzgerald
(74) *Attorney, Agent, or Firm*—King & Spalding LLP

(57) ABSTRACT

A method for evaluating rod quality and wellbore dynamics includes receiving information about the rod size and tong type for a rod pulling operation. Expected breakout pressures can be determined based on the rod size and/or tong type and can be input into an evaluation system. Upper and lower limits for acceptable rod breakout pressures can be calculated based on the expected breakout pressure and/or rod size. Actual rod breakout pressures can be evaluated while pulling rods from a well and compared to the upper and lower limits. Rod breakout pressures below the lower limit or above the upper limit can generate an alarm notifying a rig operator to evaluate the condition of the rod to determine if the rod can be reused. The rod breakout pressures can be recorded as breakout pressure data for further evaluation, including determinations of improper rod make-up and poor well conditions.

25 Claims, 13 Drawing Sheets

METHOD AND SYSTEM FOR EVALUATING ROD BREAKOUT BASED ON TONG PRESSURE DATA

FIELD OF THE INVENTION

The current invention generally relates to the breakout of threaded sucker rods and tubing being pulled out of oil or other types of wells. More specifically, the invention pertains to methods of monitoring and evaluating breakout pressures of sucker rods to assist in determining rod grading and wellbore damage.

BACKGROUND OF THE INVENTION

Oil wells and many other types of wells often comprise a wellbore lined with a steel casing. A casing is a string of pipes that are threaded at each end to be interconnected by a series of internally threaded pipe couplings. A lower end of the casing is perforated to allow oil, water, gas, or other targeted fluid to enter the interior of the casing.

Disposed within the casing is another string of pipes interconnected by a series of threaded pipe couplings. This internal string of pipes, known as tubing, has a much smaller diameter than casing. Fluid in the ground passes through the perforations of the casing to enter an annulus between the inner wall of the casing and the outer wall of the tubing. From there, the fluid forces itself through openings in the tubing and then up through the tubing to ground level, provided the fluid is under sufficient pressure.

If the natural fluid pressure is insufficient, a reciprocating piston pump is installed at the bottom of the tubing to force the fluid up the tubing. A reciprocating drive at ground level is coupled to operate the pump's piston by way of a long string of sucker rods (or "rods") that is driven up and down within the interior of the tubing. A string of sucker rods is typically comprised of individual solid rods that are threaded at each end so they can be interconnected by threaded couplings.

Since casings, tubing and sucker rods often extend thousands of feet, so as to extend the full depth of the well, it is imperative that their respective coupling connections be properly tightened to avoid costly repair and downtime. Couplings for tubing (i.e., couplings for tubing and casings), and couplings for sucker rods are usually tightened using a tool known as tongs. Tongs vary in design to suit particular purposes, i.e., tightening tubing or rods, however, each variety of tongs shares a common purpose of torquing one threaded element relative to another. Tongs typically include a hydraulic motor that delivers a torque to a set of jaws that grip the element or elements being tightened.

As a function of preventative maintenance or when maintenance is to be done on portions of the well, the sucker rods and tubing can be removed from the well to conduct an analysis of or fix wellbore conditions. As the sucker rods and tubing are removed from the well, each rod and/or tubing must be broken out from the coupling that attaches one rod to another. Once a breakout of the rod or tubing has occurred, the operator must determine if the rod or tubing will be reused or if it is too badly damaged. If the sucker rods and/or tubing are of poor quality, such as having damaged threads, they can leak and cause further damage to it and other components in the well. How the sucker rods and tubing break out can also be a predictor of future pin failures in the rods or tubing. If the breakout occurs at pressures substantially above those that are expected, the cause may be linked to damaged threads, which will limit the ability for that rod to create a proper seal if it is made-up and run back into the well. On the other hand, if the breakout occurs at pressures substantially below those that are expected, the cause may be linked to the pump or to a rod/pump interaction.

Various quality control procedures have been developed in an attempt to ensure that only sucker rods and tubing of good quality are reused in the well. However, operators and rig personnel are often under a tight timeframe to remove the sucker rods and tubing, fix the well, and rerun the equipment back into the well. In many cases, operators are too busy to give proper attention to rods and tubing that may already be damaged. Consequently, a need exists for a display system and evaluation methodology that records and evaluates the breakout pressures for sucker rods and tubing and notifies the operator of the rig if the breakout pressures are outside of an expected range, thereby identifying those rods and tubing most likely to need replacement.

The present invention is directed to solving these as well as other similar issues in related to the breakout of rods and tubing.

SUMMARY OF THE INVENTION

A method for evaluating rod quality and wellbore dynamics includes receiving information about the rod size and tong type for a rod pull. Expected breakout pressures can be determined based on the rod size and tong type and can be input into a computer system, which can be located on the well service rig. Upper and lower limits for acceptable rod breakout pressures can be calculated based on the expected breakout pressure and/or rod size. Actual rod breakout pressures can be evaluated during a rod pull from a well, recorded on a graphical display, and compared to the upper and lower pressure limits. Rod breakout pressures below the lower limit or above the upper limit can generate an alarm notifying a rig operator to evaluate the condition of the rod to determine if the rod can be reused. In addition, the graphical display can provide the operator with information regarding strings of breakout pressures above or below the expected ranges and can signal problems that may be located within the wellbore itself. In addition, the rod breakout pressures can be evaluated to determined average and mean breakout pressures, a determination of the number of breakouts that occurred above the upper breakout limit, a determination of the number of breakouts that occurred below the lower breakout limit, and the total number or rods or tubing that were pulled from the wellbore.

For one aspect of the present invention, a method for evaluating pipe quality based on breakout characteristics includes accepting an expected breakout pressure for the pipe. The pipe can include rods and tubing and the expected breakout pressure can be determined based on the size of the rods or tubing. An upper limit breakout pressure can be accepted at a computer on the well service rig. The upper limit breakout pressure can be determined based on the expected breakout pressure or it can be input by a rig operator or worker. Actual breakout pressures for each rod and coupling or tubing and coupling can be received and evaluated during a pull procedure from a well. These actual breakout pressures can then be compared to the upper limit breakout pressure to determine if the actual breakout pressure is above the upper limit breakout pressure.

For another aspect of the present invention, a method for evaluating pipe quality based on breakout characteristics includes accepting an expected breakout pressure for the pipe. The pipe can include rods and tubing and the expected breakout pressure can be determined based on the size of the rods or tubing. An upper limit and a lower limit breakout pressure can be accepted at a computer on the well service rig. Each of the upper and lower limit breakout pressures can be determined based on the expected breakout pressure or it can be input by a rig operator or worker. Actual peak breakout pressures for each rod and coupling or tubing and coupling can be received and evaluated during a pull procedure from a well. These actual peak breakout pressures can be compared to the upper limit and lower limit breakout pressures to determine if the actual peak breakout pressure is above the upper limit breakout pressure or below the lower limit breakout pressure. If the actual peak breakout pressure is above the upper limit or below the lower limit, an alarm can be activated alerting the operator that the pipe should be more closely evaluated for defects.

For yet another aspect of the present invention, a method for evaluating rod quality based on breakout characteristics includes receiving an input comprising the size of the rod to be broken out in the pipe string. An upper limit and a lower limit breakout pressure can be determined based on the rod size and can be accepted at or accessed by a computer on a well service rig completing the rod pull. Actual peak breakout pressure data for each rod can be determined and evaluated during or after a pull procedure from a well. These actual peak breakout pressures can be compared to the upper limit and lower limit breakout pressures to determine if the actual peak breakout pressure is above the upper limit breakout pressure or below the lower limit breakout pressure. If the actual peak breakout pressure is above the upper limit or below the lower limit, an alarm can be activated alerting the operator that the rod should be more closely evaluated for defects. An examination of the rod can ensue and a determination can be made whether to reuse the rod in the well.

These and other objects of the present invention are provided by a display for and method of analysis of data relating to breakout pressure for rods and tubing.

DETAILED DESCRIPTION OF THE EXEMPLARY EMBODIMENTS

Exemplary embodiments of the invention will now be described in detail with reference to the included figures. The exemplary embodiments are described in reference to how they might be implemented. In the interest of clarity, not all features of an actual implementation are described in this specification. Those of ordinary skill in the art will appreciate that in the development of an actual embodiment, several implementation-specific decisions must be made to achieve the inventors' specific goals, such as compliance with system-related and business-related constraints which can vary from one implementation to another. Moreover, it will be appreciated that such a development effort might be complex and time-consuming, but would nevertheless be a routine undertaking for those of ordinary skill in the art having benefit of this disclosure. Further aspects and advantages of the various figures of the invention will become apparent from consideration of the following description and review of the figures. While references are generally made hereinafter to rods or tubing specifically, with the description of the figures, each reference should be read broadly to include both rods and tubing unless specifically limited therein.

Figure 1:
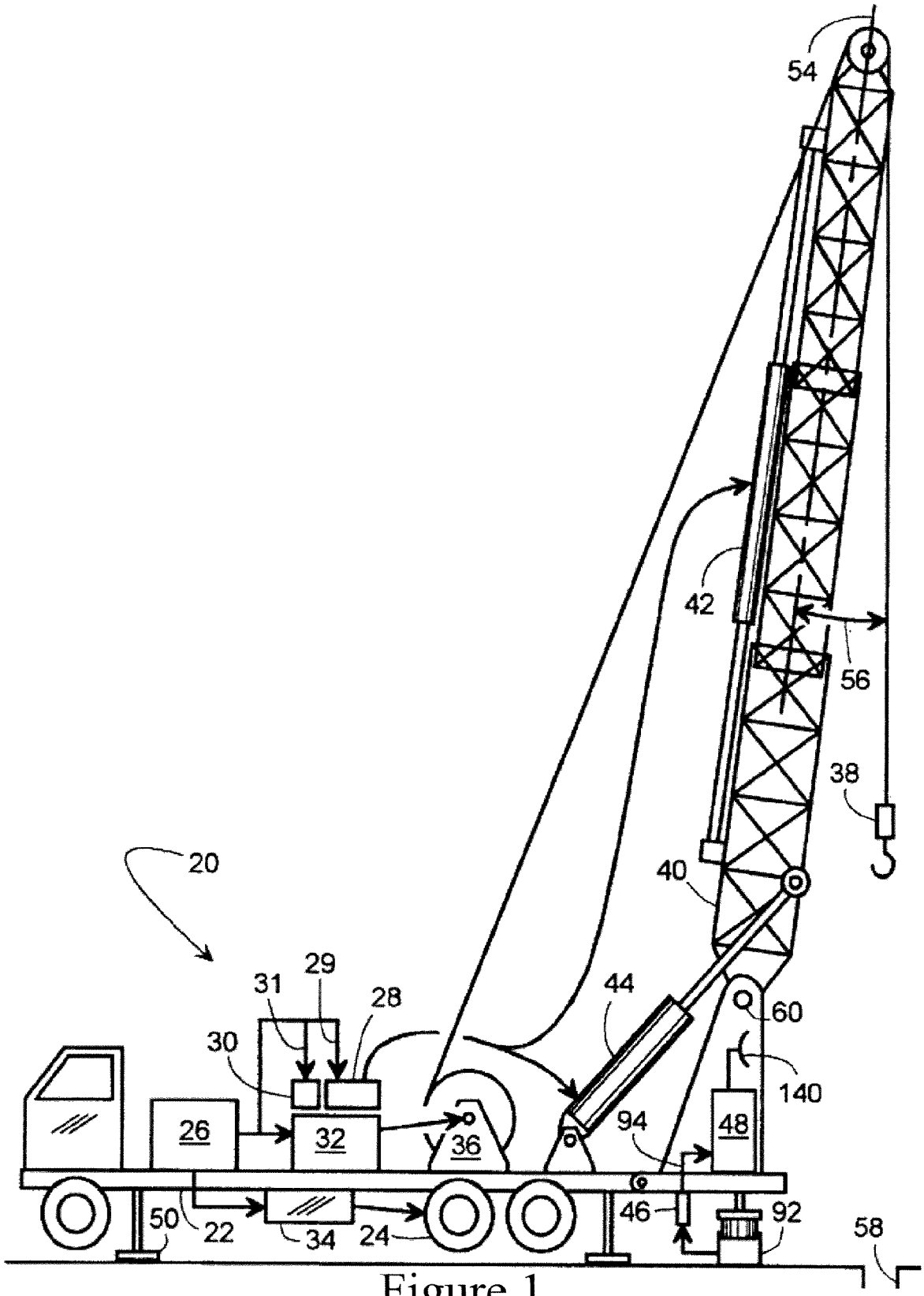
FIG. 1 is a side view of an exemplary mobile repair unit with its derrick extended according to one exemplary embodiment of the present invention.

Referring to FIG. 1, a retractable, self-contained mobile repair unit 20 is presented to include a truck frame 22 supported on wheels 24, an engine 26, a hydraulic pump 28, an air compressor 30, a first transmission 32, a second transmission 34, a variable speed hoist 36, a block 38, an extendible derrick 40, a first hydraulic cylinder 42, a second hydraulic cylinder 44, a first transducer 46, a monitor 48, and retractable feet 50.

Figure 2:
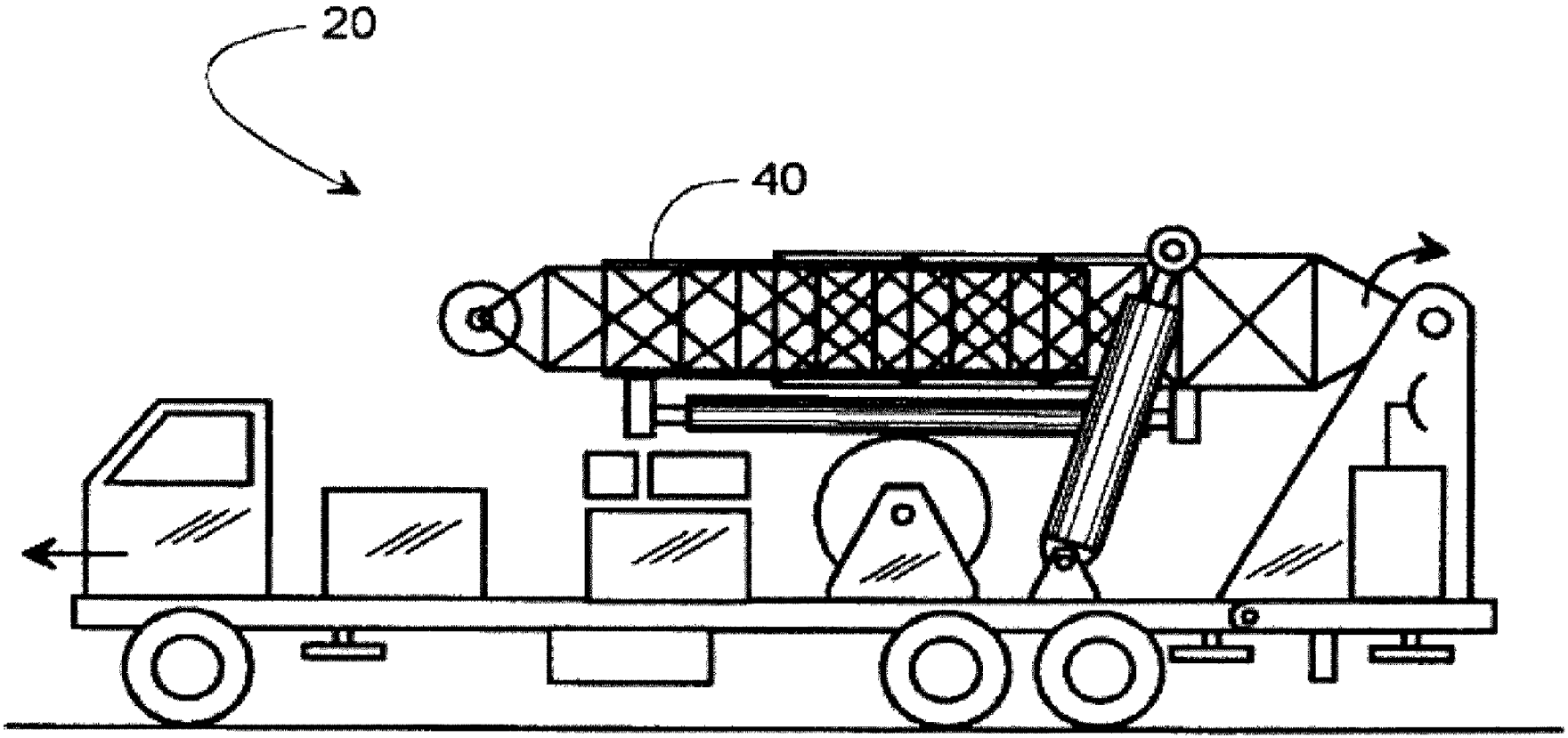
FIG. 2 is a side view of the exemplary mobile repair unit with its derrick retracted according to one exemplary embodiment of the present invention.

The engine 26 selectively couples to the wheels 24 and the hoist 36 by way of the transmissions 34 and 32, respectively. The engine 26 also drives the hydraulic pump 28 via the line 29 and the air compressor 30 via the line 31. The compressor 30 powers a pneumatic slip (Not Shown), and pump powers a set of hydraulic tongs (Not Shown). The pump 28 also powers the cylinders 42 and 44 which respectively extend and pivot the derrick 40 to selectively place the derrick 40 in a working position, as shown in FIG. 1, and in a lowered position, as shown in FIG. 2. In the working position, the derrick 40 is pointed upward, but its longitudinal centerline 54 is angularly offset from vertical as indicated by the angle 56. The angular offset provides the block 38 access to a wellbore 58 without interference with the derrick pivot point 60. With the angular offset 56, the derrick framework does not interfere with the typically rapid installation and removal of numerous inner pipe segments (known as pipe, inner pipe string, rods, or tubing 62, hereinafter "tubing" or "rods").

Individual pipe segments (of string 62) and sucker rods are screwed to themselves using hydraulic tongs. The term "hydraulic tongs" used herein and below refer to any hydraulic tool that can screw together two pipes or sucker rods. An example would include those provided by B. J. Hughes company of Houston, Tex. In operation, the pump 28 drives a hydraulic motor (Not Shown) forward and reverse by way of a valve. Conceptually, the motor drives the pinions which turn a wrench element relative to a clamp. The element and clamp engage flats on the mating couplings of a sucker rod or an inner pipe string 62 of one conceived embodiment of the invention. However, it is well within the scope of the invention to have rotational jaws or grippers that clamp on to a round pipe (i.e., no flats) similar in concept to a conventional pipe wrench, but with hydraulic clamping. The rotational direction of the motor determines assembly or disassembly of the couplings.

While not explicitly shown in the figures, when installing the tubing segments 62, the pneumatic slip is used to hold the tubing 62 while the next segment of tubing 62 is screwed on using tongs. A compressor 30 provides pressurized air through a valve to rapidly clamp and release the slip. A tank helps maintain a constant air pressure. Pressure switch provides the monitor 48 (FIG. 3) with a signal that indirectly indicates that the rig 20 is in operation.

Figure 3:
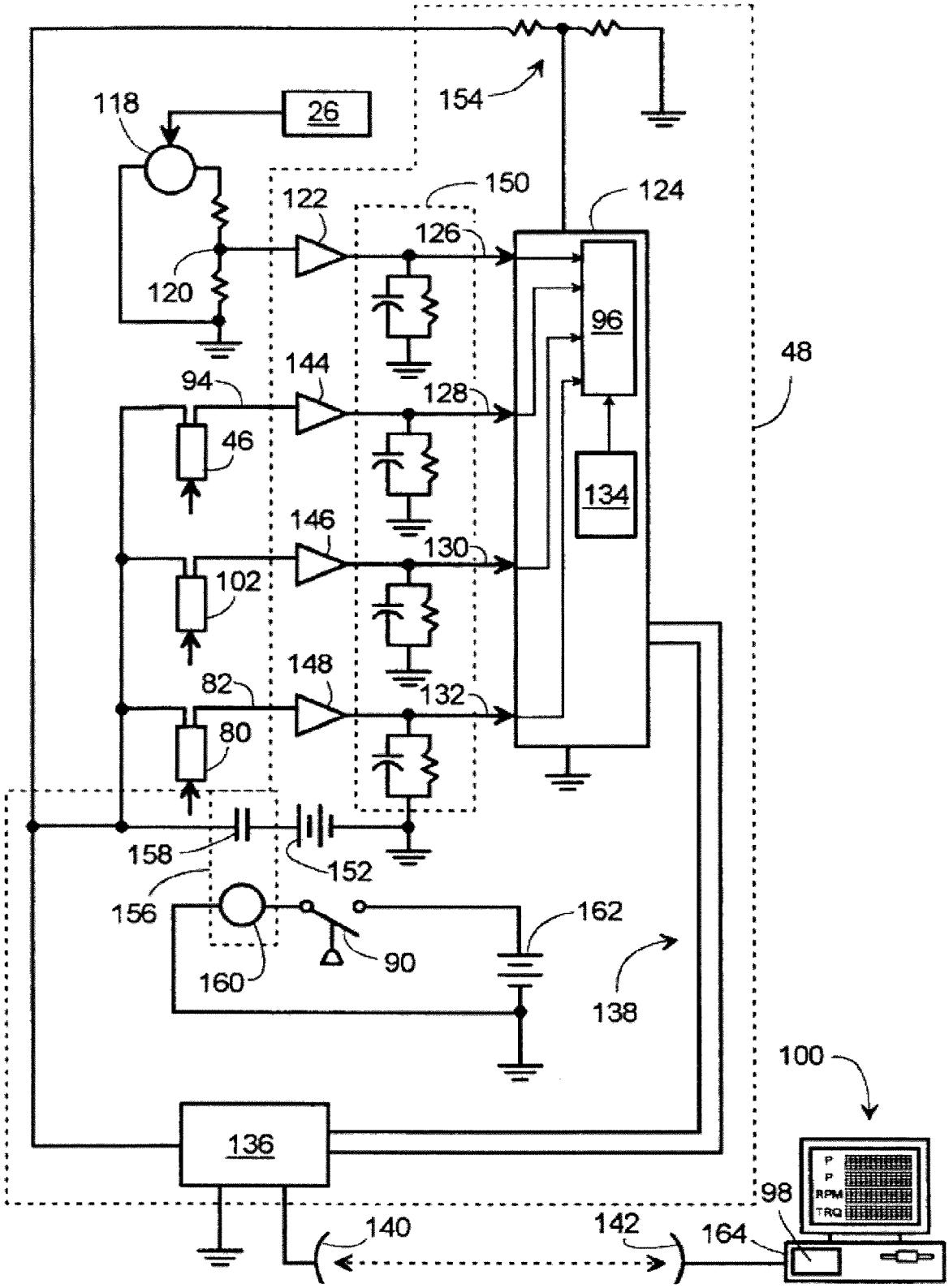
FIG. 3 is an electrical schematic of a monitor circuit according to one exemplary embodiment of the present invention.

Referring back to FIG. 1, weight applied to the block 38 is sensed by way of a hydraulic pad 92 that supports the weight of the derrick 40. The hydraulic pad 92 is basically a piston within a cylinder (alternatively a diaphragm) such as those provided M. D. Totco company of Cedar Park, Tex. Hydraulic pressure in the pad 92 increases with increasing weight on the block 38. In FIG. 3, the first transducer 46 converts the hydraulic pressure to a 0-5 VDC signal 94 that is conveyed to the monitor 48. The monitor 48 converts signal 94 to a digital value, stores it in a memory 96, associates it with a real time stamp, and eventually communicates the data to a remote computer 100 or the computer 605, of FIG. 6, by way of hardwire, a modem 98, T1 line, WiFi or other device or method for transferring data known to those of ordinary skill in the art.

Returning to FIG. 3, transducers 46 and 102 are shown coupled to the monitor 48. The transducer 46 indicates the pressure on the left pad 92 and the transducer 102 indicates the pressure on the right pad 92. A generator 118 driven by the engine 26 provides an output voltage proportional to the engine speed. This output voltage is applied across a dual-resistor voltage divider to provide a 0-5 VDC signal at point 120 and then passes through an amplifier 122. A generator 118 represents just one of many various tachometers that provide a feedback signal proportional to the engine speed. Another example of a tachometer would be to have engine 26 drive an alternator and measure its frequency. The transducer 80 provides a signal proportional to the pressure of hydraulic pump 28, and thus proportional to the torque of the tongs.

A telephone accessible circuit 124, referred to as a "POCKET LOGGER" by Pace Scientific, Inc. of Charlotte, N.C., includes four input channels 126, 128, 130 and 132; a memory 96 and a clock 134. The circuit 124 periodically samples inputs 126, 128, 130 and 132 at a user selectable sampling rate; digitizes the readings; stores the digitized values; and stores the time of day that the inputs were sampled. It should be appreciated by those skilled in the art that with the appropriate circuit, any number of inputs can be sampled and the data could be transmitted instantaneously upon receipt.

A supervisor at a computer 100 remote from the work site at which the service rig 20 is operating accesses the data stored in the circuit 124 by way of a PC-based modem 98 and a cellular phone 136 or other known methods for data transfer. The phone 136 reads the data stored in the circuit 124 via the lines 138 (RJ11 telephone industry standard) and transmits the data to the modem 98 by way of antennas 140 and 142. In an alternative embodiment the data is transmitted by way of a cable modem or WiFi system (Not Shown). In one exemplary embodiment of the present invention, the phone 136 includes a CELLULAR CONNECTION.TM. provided by Motorola Incorporated of Schaumburg, Ill. (a model S1936C for Series II cellular transceivers and a model S1688E for older cellular transceivers).

Figure 4:
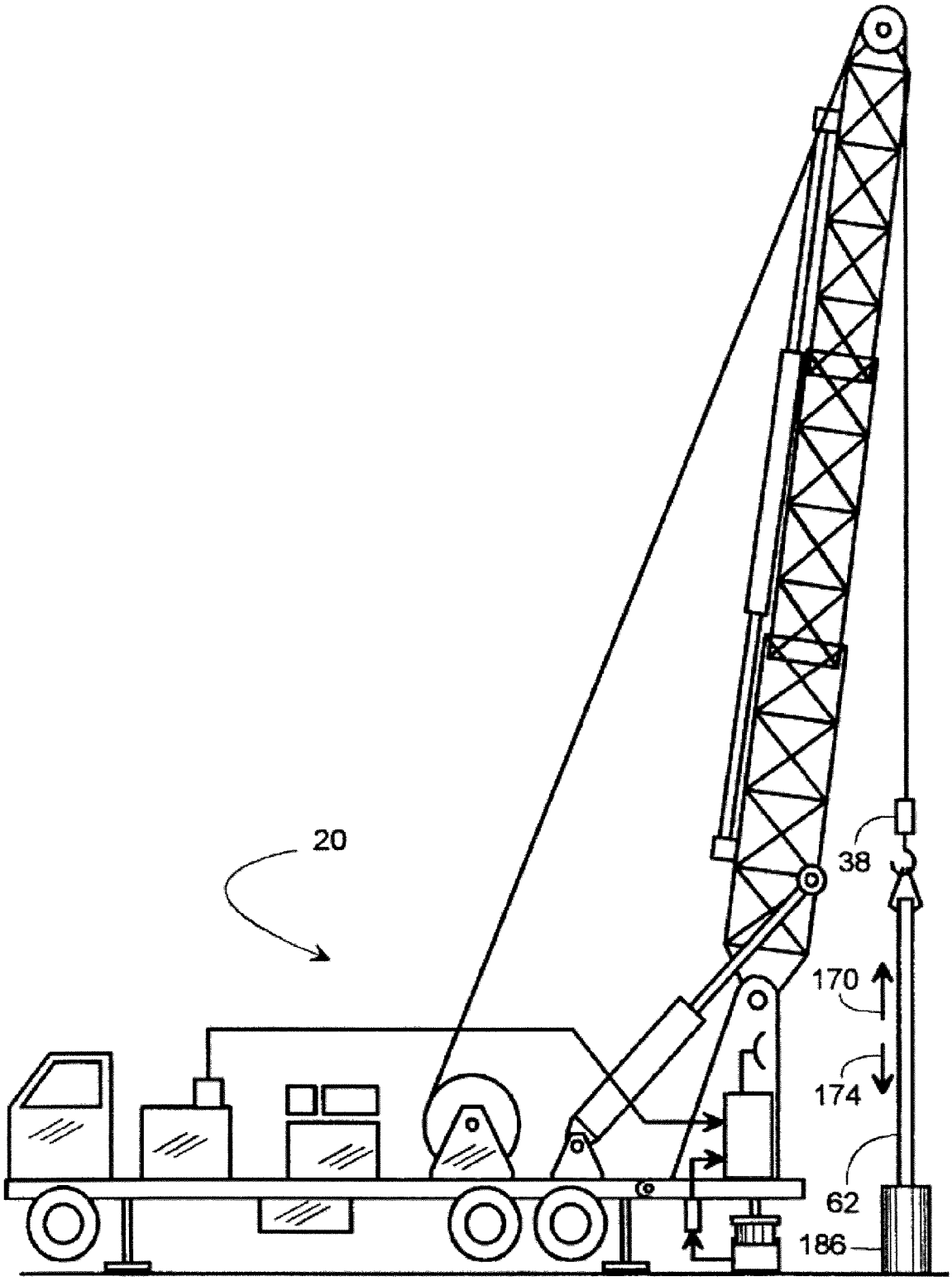
FIG. 4 illustrates the raising and lowering of an inner tubing string with an exemplary mobile repair unit according to one exemplary embodiment of the present invention.

Some details worth noting about the monitor 48 is that its access by way of a modem makes the monitor 48 relatively inaccessible to the crew at the job site itself. However the system can be easily modified to allow the crew the capability to edit or amend the data being transferred. The amplifiers 122, 144, 146 and 148 condition their input signals to provide corresponding inputs 126, 128, 130 and 132 having an appropriate power and amplitude range. Sufficient power is needed for RC circuits 150 which briefly (e.g., 2-10 seconds) sustain the amplitude of inputs 126, 128, 130 and 132 even after the outputs from transducers 46, 102 and 80 and the output of the generator 118 drop off. This ensures the capturing of brief spikes without having to sample and store an excessive amount of data. A DC power supply 152 provides a clean and precise excitation voltage to the transducers 46, 102 and 80; and also supplies the circuit 124 with an appropriate voltage by way of a voltage divider 154. A pressure switch 90 enables the power supply 152 by way of the relay 156, whose contacts 158 are closed by the coil 160 being energized by the battery 162. FIG. 4 presents an exemplary display representing a service rig 20 lowering an inner pipe string 62 as represented by arrow 174 of FIG. 4.

Figure 5:
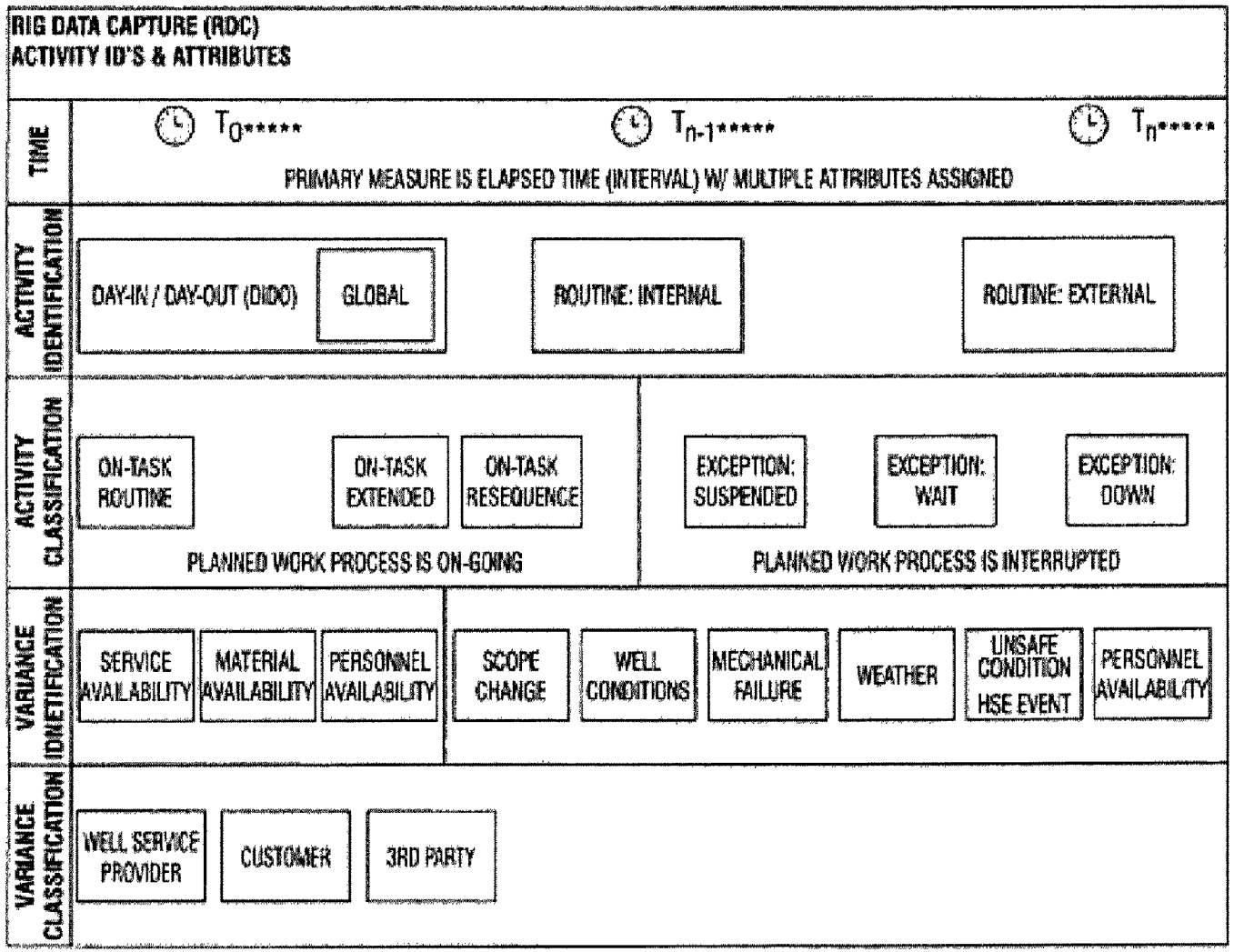
FIG. 5 illustrates one embodiment of an activity capture methodology outlined in tabular form according to one exemplary embodiment of the present invention.

FIG. 5 provides an illustration of an activity capture methodology in tabular form according to one exemplary embodiment of the present invention. Now referring to FIG. 5, an operator first chooses an activity identifier for his/her upcoming task. If "GLOBAL" is chosen, then the operator would choose from rig up/down, pull/run tubing or rods, or laydown/pickup tubing and rods (options not shown in FIG. 6). If "ROUTINE: INTERNAL" is selected, then the operator would choose from rigging up or rigging down an auxiliary service unit, longstroke, cut paraffin, nipple up/down a BOP, fishing, jarring, swabbing, flowback, drilling, clean out, well control activities such as killing the well or circulating fluid, unseating pumps, set/release tubing anchor, set/release packer, and pick up/laydown drill collars and/or other tools. Finally, if "ROUTINE: EXTERNAL" is chosen, the operator would then select an activity that is being performed by a third party, such as rigging up/down third party servicing equipment, well stimulation, cementing, logging, perforating, or inspecting the well, and other common third party servicing tasks. After the activity is identified, it is classified. For all classifications other than "ON TASK: ROUTINE," a variance identifier is selected, and then classified using the variance classification values.

Figure 6:
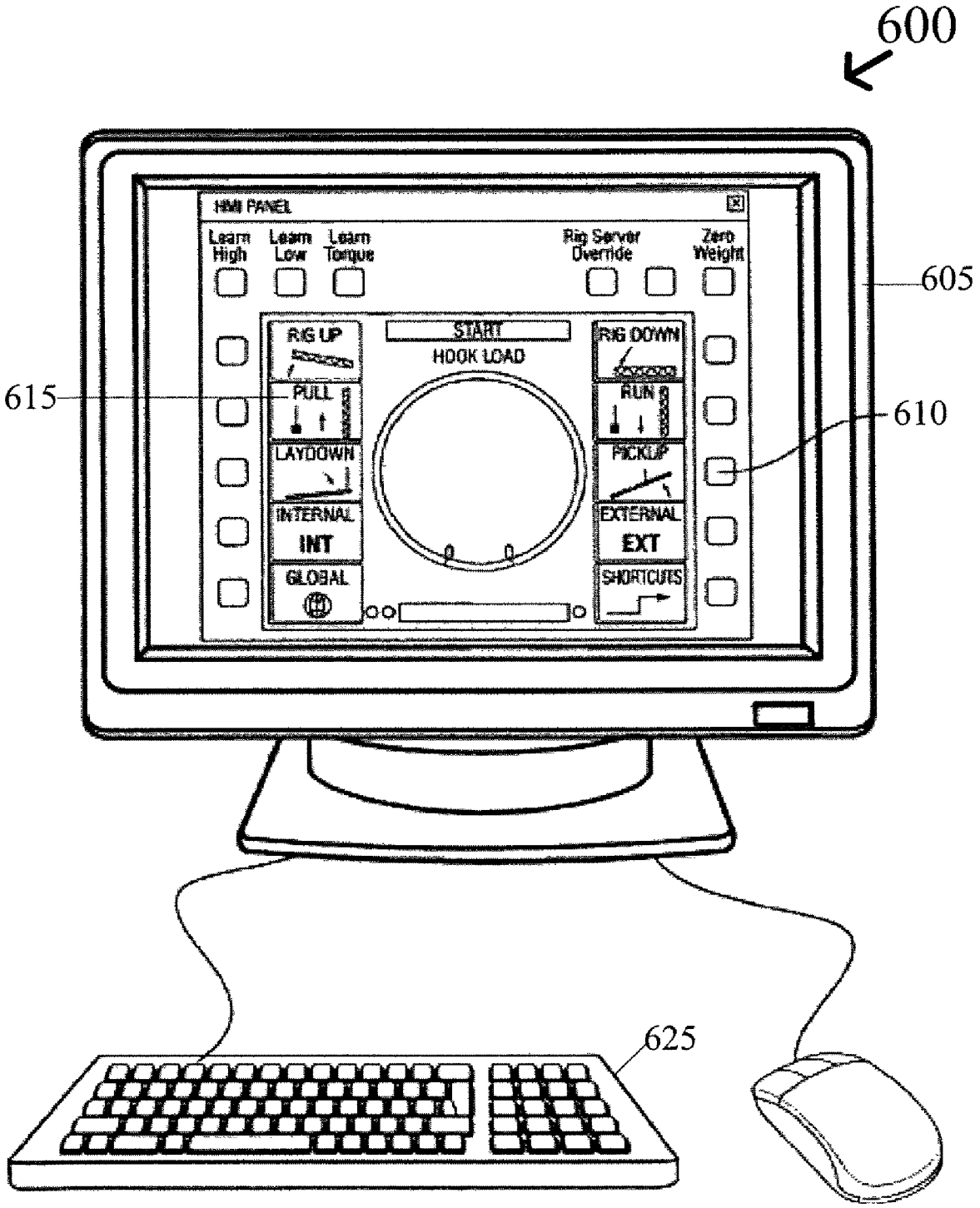
FIG. 6 provides a frontal view of an exemplary operator interface according to one exemplary embodiment of the present invention.

FIG. 6 provides a view of an rig operator interface or supervisor interface according to one exemplary embodiment of the present invention. Now referring to FIG. 6, all that is required from the operator is that he or she input in the activity data into a computer 605. The operator can interface with the computer 605 using a variety of means, including typing on a keyboard 625 or using a touch-screen 610. In one embodiment, a display 610 with pre-programmed buttons, such as pulling rods or tubing from a wellbore 615, is provided to the operator, as shown in FIG. 6, which allows the operator to simply select the activity from a group of pre-programmed buttons. For instance, if the operator were presented with the display 610 of FIG. 6 upon arriving at the well site, the operator would first press the "RIG UP" button. The operator would then be presented with the option to select, for example, "SERVICE UNIT," "AUXILIARY SERVICE UNIT," or "THIRD PARTY." The operator then would select whether the activity was on task, or if there was an exception, as described above. In addition, as shown in FIG. 6, prior to pulling (removing) 615 or running (inserting) rods 62, the operator could set the high and low limits for the block 38 by pressing the learn high or learn low buttons after moving the block 38 into the proper position.

Figure 7:
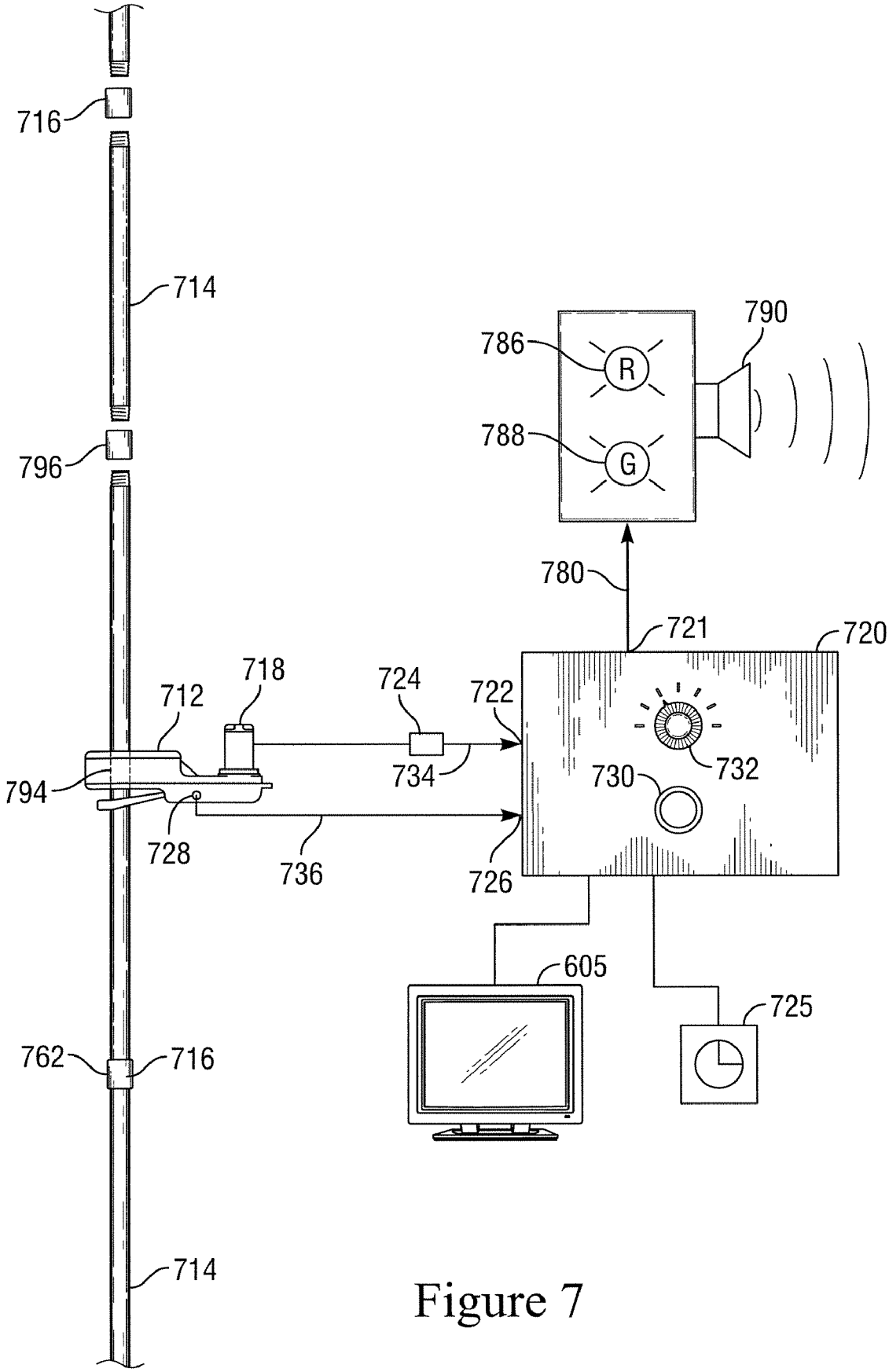
FIG. 7 is a schematic diagram of a system that monitors a set of tongs tightening a string of elongated members according to one exemplary embodiment of the present invention.

Turning now to FIG. 7, a frontal view of an exemplary operator interface is presented according to one exemplary embodiment of the present invention. Referring now to FIG. 7, a display 610 for monitoring the tightening operation of a set of tongs 712 is presented. The display 610 includes a learning mode that enables the display 610 to adapt to various tongs 712 and operating conditions. After temporarily operating in the learning mode, display 610 shifts to a monitoring mode. Readings taken during the monitoring mode are compared to those taken during the learning mode to determine whether any changes occurred during the tightening operation.

Tongs 712 are schematically illustrated to represent various types of tongs including, but not limited to, those used for tightening sucker rods, tubing or casings. In FIG. 7, tongs 712 are shown being used in assembling a string of elongated members 714, which are schematically illustrated to represent any elongated member with threaded ends for interconnecting members 714 with a series of threaded couplings 716. Examples of elongated members 714 include, but are not limited to sucker rods, tubing, and casings. Tongs 712 include at least one set of jaws for gripping and rotating one elongated member 714 relative to another, thereby screwing at least one elongated member into an adjacent coupling 716. A drive unit 718 drives the rotation of the jaws. The drive unit 718 is schematically illustrated to represent various types of drive units including those that can move linearly (e.g., piston/cylinder) or rotationally and can be powered hydraulically, pneumatically or electrically.

In one exemplary embodiment, the display 610 comprises an electrical circuit 720 that is electrically coupled to an output 721 and four inputs. The electrical circuit 720 is schematically illustrated to represent any circuit adapted to receive a signal through an input and respond through an output. Examples of the circuit 720 include, but are not limited to, computers, programmable logic controllers, circuits comprising discrete electrical components, circuits comprising integrated circuits, and various combinations thereof.

The inputs of the circuit 720, according to certain embodiments, include a first input 722 electrically coupled to a first sensor 724, a second input 726 electrically coupled to a second sensor 728, a learn input 730, and a tolerance input 732. However, it should be noted that display 610 with fewer inputs or with inputs other than those used in this example are well within the scope of the invention.

In response to the rotational action or tightening action of the tongs 712, the sensors 724 and 728 provide the input signals 734 and 736 respectively. The term, "rotational action" refers to any rotational movement of any element associated with a set of tongs 712. Examples of such an element include, but are not limited to, gears, jaws, sucker rods, couplings, and tubing. The term, "tightening action" refers to an effort applied in tightening a threaded connection. The sensors 724 and 728 are schematically illustrated to represent a wide variety of sensors that respond to the rotational or tightening action of the tongs 712. Examples of sensors 724 and 728 include, but are not limited to, a pressure sensor (e.g., for sensing hydraulic pressure of a hydraulic motor); strain gage (e.g., for sensing strain as the tongs exert torque) limit switch (e.g., used as a counter for counting passing gear teeth or used in detecting a kickback action of the tongs 712 as it begins tightening a joint); hall effect sensor, proximity switch, or photoelectric eye (e.g., used as a counter for counting passing gear teeth); and a current sensor (e.g., for measuring the power or electrical current delivered to an electric motor in cases where an electric motor serves as the tongs' 712 drive unit).

The learn input 730 and tolerance input 732 are user interface elements that allow an operator to affect the operation of the display 610 in ways that will be explained later. The display 610 may be communicably attached to the circuit 720, the sensors 724, 728 and the inputs 730 and 732. In one exemplary embodiment, the display 610 provides graphical feedback to the operator; however, those of ordinary skill in the art will recognize that the display 610 may include, but is not limited to, a touch screen display, plotter, printer, or other device for generating graphical representations. The display 610 also includes a timer 725 communicably connected to the circuit 720. In one exemplary embodiment, the timer 725 can be any device that can be employed with a computer, programmable logic controller or other control device to determine the elapsed time from receiving an input.

Figure 8:
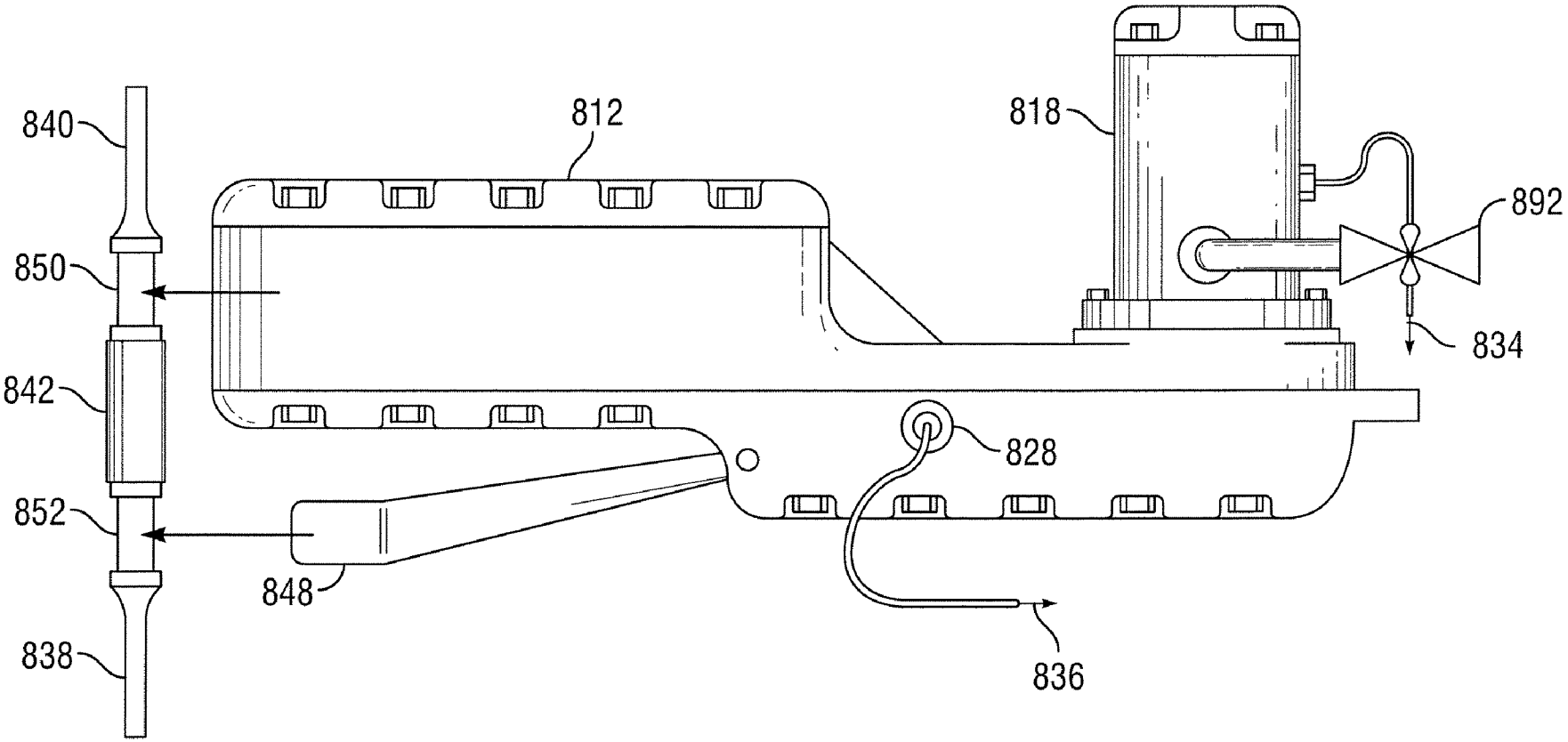
FIG. 8 is a side view of a set of tongs about to tighten two sucker rods into a coupling according to one exemplary embodiment of the present invention.
Figure 9:
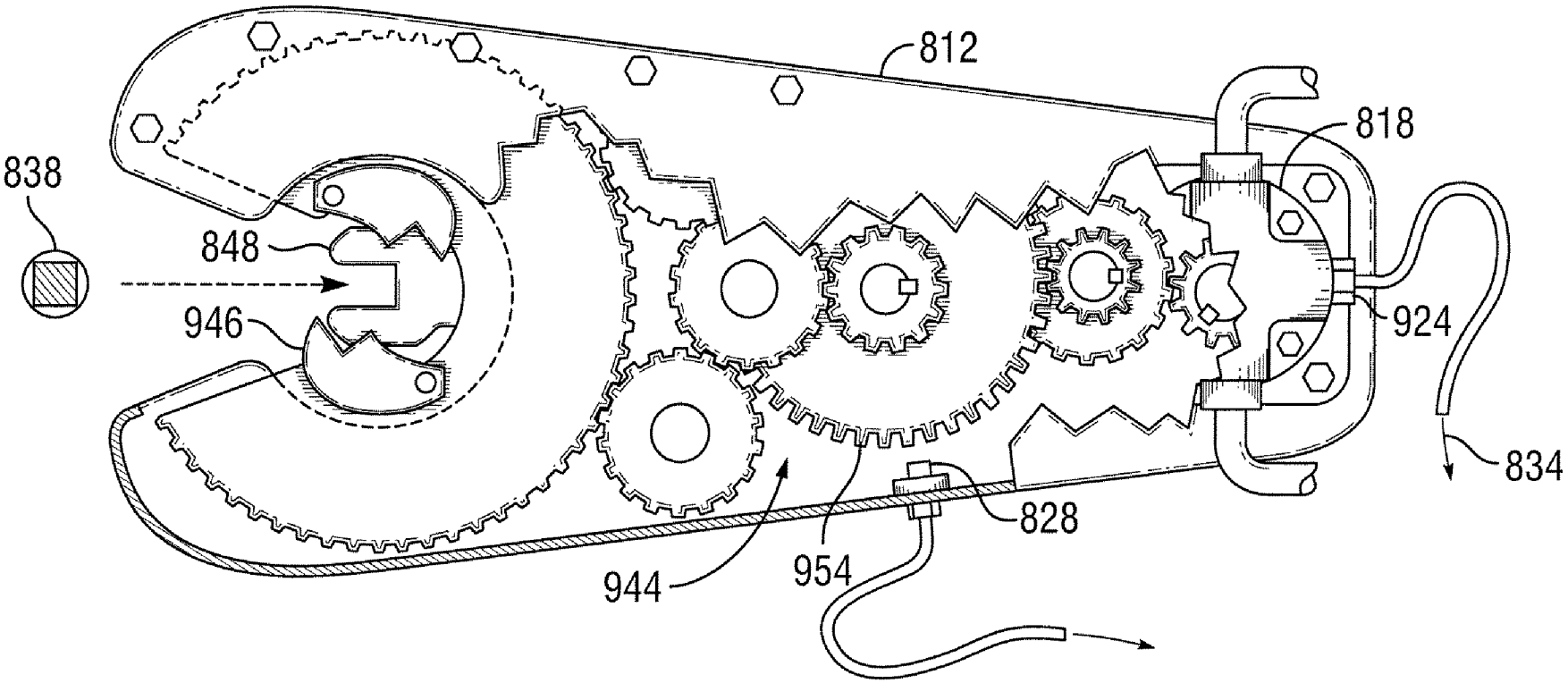
FIG. 9 is a cut-away top view of the tongs according to the exemplary embodiment of FIG. 8.

For illustration, the display 610 will be described with reference to a set of sucker rod tongs 812 used for screwing two sucker rods 838 and 840 into a coupling 842, as shown in FIGS. 8 and 9. However, it should emphasized that the display 610 can be readily used with other types of tongs 812 for tightening other types of elongated members. In this example, a hydraulic motor 818 is the drive unit of the tongs 812. The motor 818 drives the rotation of various gears of a drive train 944, which rotates an upper set of jaws 946 relative to a lower set of jaws 848. The upper jaws 946 are adapted to engage flats 850 on the sucker rod 840, and the lower jaws 848 engage the flats 852 on the rod 838. So, as the upper jaws 946 rotate relative to the lower jaws 848, the upper sucker rod 840 rotates relative to the lower rod 838, which forces both rods 838 and 840 to tightly screw into the coupling 842.

In the example of FIGS. 8 and 9, a sensor 924 is a conventional pressure sensor in fluid communication with the motor 818 to sense the hydraulic pressure that drives the motor 818. The hydraulic pressure increases with the amount of torque exerted by the tongs 812, such that the sensor 924 provides an input signal 834 that reflects that torque. The motor 818 may also include a pressure relief valve 892. The pressure relief valve 892 limits the pressure that can be applied across the motor 818, thus helping to limit the extent to which a connection can be tightened. In one exemplary embodiment, the pressure relief valve 892 is adjustable by known adjustment means to be able to vary the amount of hydraulic pressure based on rods and tubing of varying diameters ("sizes") and grades.

Processes of exemplary embodiments of the present invention will now be discussed with reference to FIGS. 10-12. Certain steps in the processes described below must naturally precede others for the present invention to function as described. However, the present invention is not limited to the order of the steps described if such order or sequence does not alter the functionality of the present invention in an undesirable manner. That is, it is recognized that some steps may be performed before or after other steps or in parallel with other steps without departing from the scope and spirit of the present invention.

Figure 10:
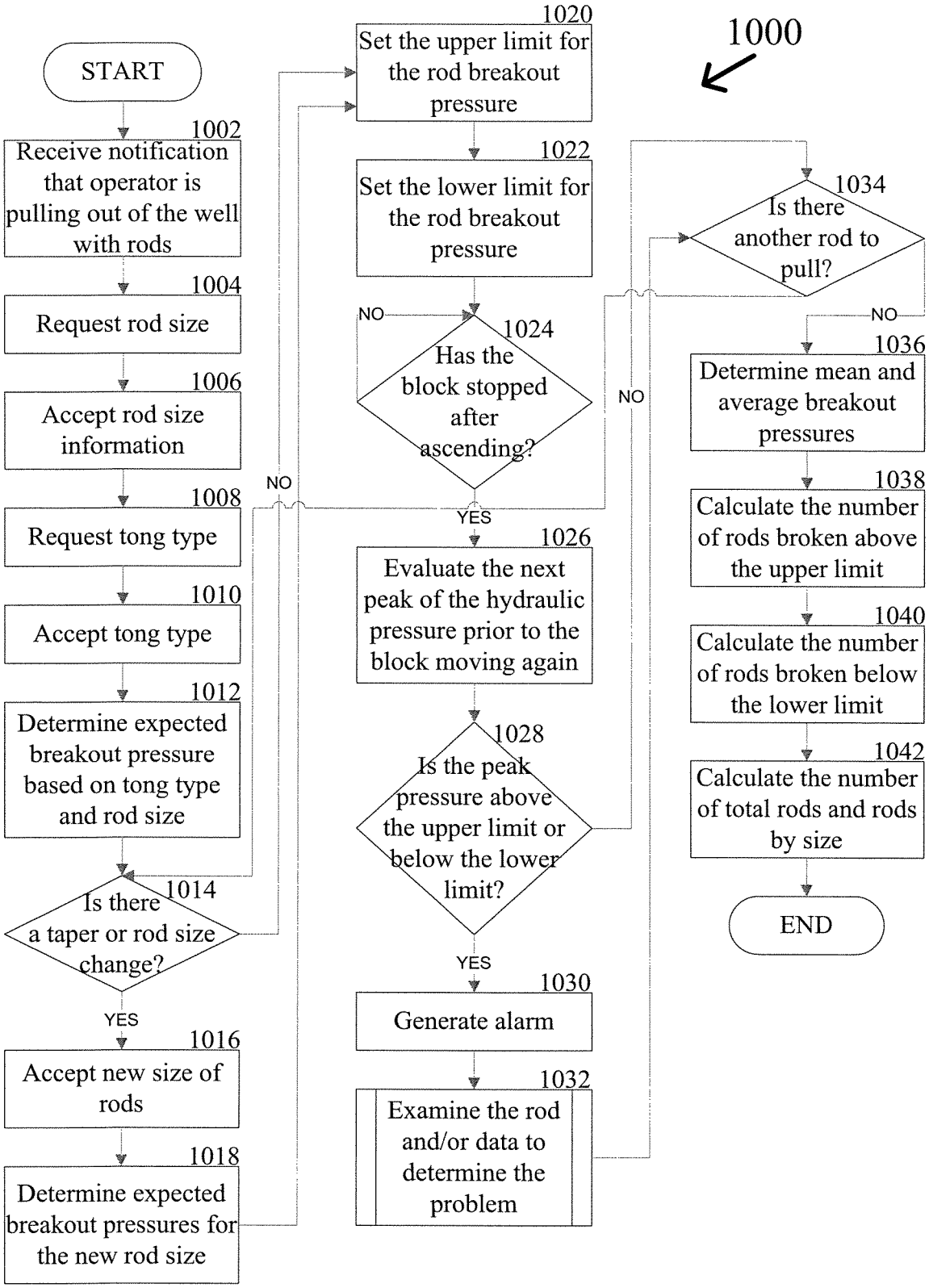
FIG. 10 is a logical flowchart diagram presenting the steps of an exemplary process for determining if rods are disassembled at a proper breakout pressure based on an evaluation of tong pressure data in accordance with one exemplary embodiment of the present invention.

Turning now to FIG. 10, a logical flowchart diagram illustrating an exemplary method 1000 for determining if rods 838 are disassembled at a proper breakout pressure based on an evaluation of tong pressure data is presented according to one exemplary embodiment of the present invention. Referring to FIGS. 1, 7, 8, and 10, the exemplary method 1000 begins at the START step and continues to step 1005, where notification is received that the operator is pulling out of the wellbore 58 with rods 838. In one exemplary embodiment, the notification is received at the computer 605 by the operator selecting the pull operation 615 on the display 610 either through the use of the keyboard 625, a mouse, or the display 610 being a touch screen display. In step 1004 the rod size is requested. In one exemplary embodiment, the rod size is requested from the operator at the display 610. Typical rod sizes include three-fourths of an inch, seven-eighths of an inch and one-inch rods 838. The rod size information is accepted in step 1006. The rod size information can be input by the operator at the keyboard 625 of the computer 605.

In certain embodiments, different types of tongs may be used for different jobs. In these embodiments, it can become necessary to provide information describing the tongs 812 currently in use. In one exemplary embodiment, two different types of tongs 812 are used: Mark IV and Mark V tongs. In step 1008 a request is made to provide information describing the tongs 812 used for the current job. In one exemplary embodiment, the request is made by the computer 605 at the display 610. The tong type information is received in step 1010 from the operator at, for example, the computer 605 through the keyboard 625; however, other input devices known in the art of computers could also be used. In step 1012, the expected breakout pressure is determined. In one exemplary embodiment, the expected breakout pressure is determined based on the tong type and the rod size. In certain exemplary embodiments, the expected breakout pressure is based on the pressure needed to properly make-up that particular rod size with that type of tong 812 when the rods 838 are being run into the well 58. In certain exemplary embodiments, the expected breakout pressure is stored within the computer 605 or in a place accessible by the computer 605, such as through the Internet. In an alternative embodiment, the operator can input the expected breakout pressure based on information related to these particular rods 838 being run into the well 58 or based on typical rods 838 and tongs 812 of the type in use for this pull operation.

In step 1014, an inquiry is conducted to determine if there is a taper or rod size change. The change in size can affect the expected breakout pressures and, therefore, the upper and/or lower pressure limits that need to be monitored. If there is not a rod size or taper change, the "NO" branch is followed to step 1020. On the other hand, if there is a rod size or taper change, the "YES" branch is followed to step 1016, where the new rod size or taper information is accepted. In one exemplary embodiment, the information is input by the operator at the computer 605. In step 1018, the computer 605, operator, or other external entity determines the expected breakout pressures for the new rod size or taper.

In step 1020, the upper limit for the rod breakout pressure is set. In one exemplary embodiment, the upper limit for the rod breakout pressure is a predetermined percentage above the expected rod breakout pressure. The predetermined percentage can be between 10-100 percent above the expected rod breakout pressure. Generally, the predetermined percentage is between 20-25 percent. In an alternative embodiment, the upper limit for the rod breakout pressure is a predetermined fixed amount above the expected rod breakout pressure. In one exemplary embodiment, the predetermined fixed amount is between 50-800 pounds per square inch ("psi") above the expected rod breakout pressure. The upper limit can be set by the computer 605 based on input information or it can be set by the operator inputting the upper limit at the computer 605 by way of the keyboard 625.

In step 1022, the lower limit for the rod breakout pressure is set. In one exemplary embodiment, the lower limit for the rod breakout pressure is a predetermined percentage below the expected rod breakout pressure. The predetermined percentage can be between 10-100 percent below the expected rod breakout pressure. In an alternative embodiment, the lower limit for the rod breakout pressure is a predetermined fixed amount below the expected rod breakout pressure. In one exemplary embodiment, the predetermined fixed amount is between 50-800 psi below the expected rod breakout pressure. The lower limit can be set by the computer 605 based on input information, such as rod size and tong type, or it can be set by the operator inputting the lower limit at the computer 605 by way of the keyboard 625.

In step 1024, an inquiry is conducted to determine if the block 38 has stopped after ascending. In certain exemplary embodiments, the determination can be made by evaluating the block position curve (Not Shown), by evaluating a readout from an encoder (Not Shown) at the hoist 36 or anywhere else along the lift line connected to the hoist 36, or by the operator activating a button signifying that the pull operation for a stand of rods 838 is complete at the display 610. If the block 38 has not stopped after ascending, the "NO" branch is followed back to step 1024 for another evaluation. Otherwise, the "YES" branch is followed to step 1026, where the next peak for the hydraulic pressure data that occurs prior to the block 38 moving vertically again is recorded and evaluated. In one exemplary embodiment, the peak hydraulic pressure is recorded and evaluated at the computer 605. In certain exemplary embodiments, the timer 725 can be used, wherein an evaluation period of a predetermined amount of time can be used to determine what the peak hydraulic pressure is, such that only the pressure occurring within that predetermined amount of time is evaluated to determine the peak hydraulic pressure. In one exemplary embodiment, the predetermined amount of time can be between one and thirty seconds.

Figure 13:
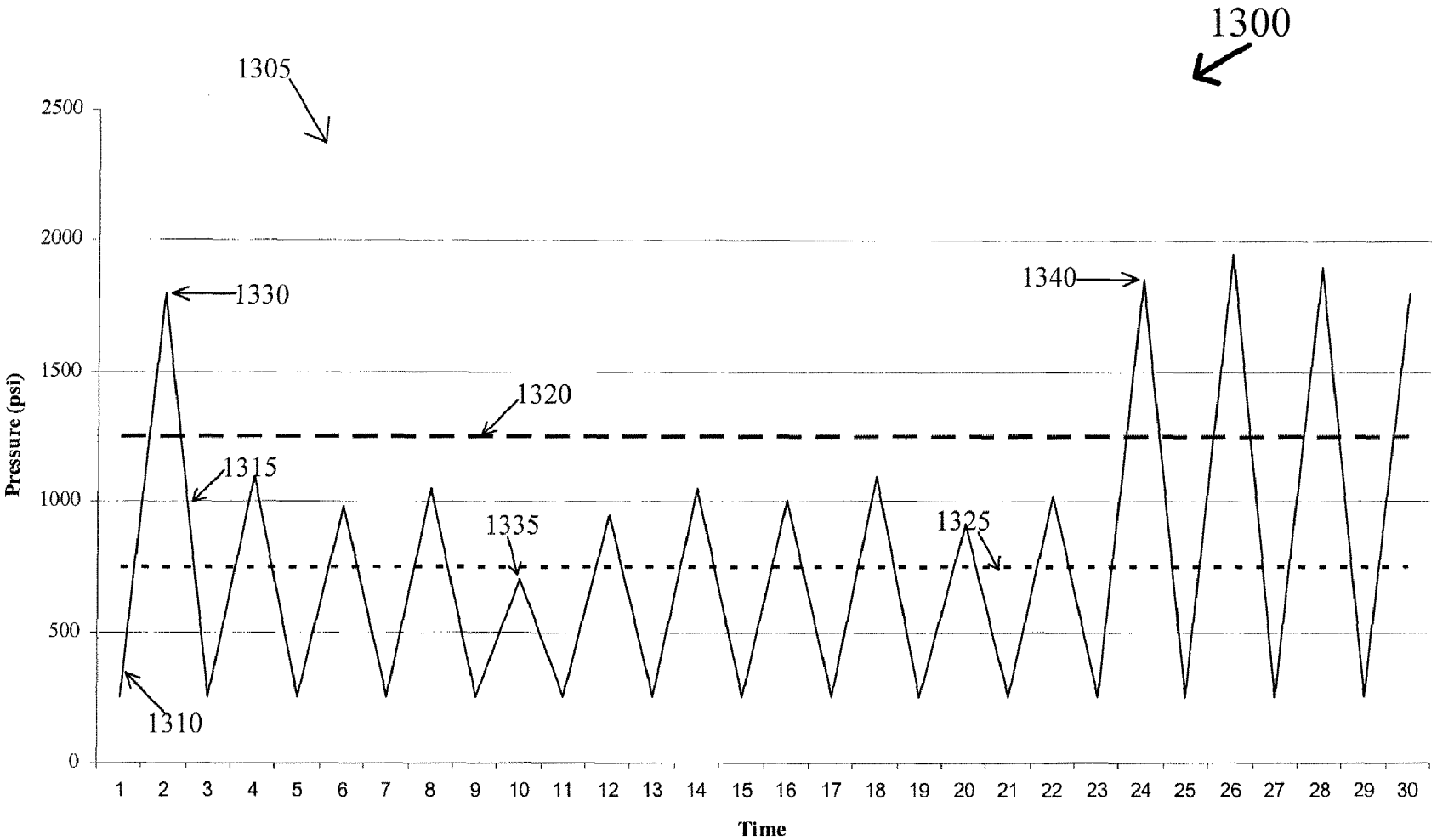
FIG. 13 is an exemplary display of a tong hydraulic pressure chart for determining if breakout pressures for rods are within a specified range in accordance with one exemplary embodiment of the present invention.

FIG. 13 presents a chart 1300 displaying the general patterns for tong hydraulic pressure data curves during a rod pulling operation in accordance with one exemplary embodiment of the present invention. Referring to FIG. 13, the exemplary chart 1300 includes a hydraulic pressure chart 1305 having an X-axis representing time and a Y-axis representing pressure in pounds per square inch; however the determination of X and Y-axes and method in which pressure is displayed is not limited to that shown in the chart 1305. The chart 1305 includes hydraulic pressure data 1310, presented as a curve on the chart 1305; however the data points 1310 could also be individually represented as unique points that are not attached to form a curve. Furthermore, pneumatic pressure and other forms of power known to those of ordinary skill in the art that can be measured and varies with the amount of work done could be substituted for hydraulic pressure.

The chart 1305 includes an expected breakout pressure 1315 represented by the line at 1000 psi, an upper limit breakout pressure 1320, represented by the dashed line at 1250 psi, and a lower limit breakout pressure 1325, represented by the dotted line at 750 psi. The data 1310 includes peaks 1330 and valleys. In one exemplary embodiment, the breakout pressure is considered to be within the expected range if the peak 1330 is between the lower limit 1325 and the upper limit 1320. As shown in the chart 1305, the peak 1330 is well above the upper limit 1320. In addition, the peak 1335 is below the lower limit and would also not be considered within range. In addition to the analysis of individual rods 838 based on breakout pressure, the data 1310 can also provide information about the condition of the well 58. As will be described in greater detail hereinafter, when certain areas of the rod string 62 are above the upper limit, while other areas have been predominantly within range, it can mean that there is a problem with the well 58 in the area that the rods 838 having breakout pressures above the upper limit 1320 were positioned in. For example, as shown on the chart 1305, prior to data point 24, a majority of the data peaks are within the expected range. However, from data point 24 onward, the data peaks are above the upper limit 1320. The computer 605 can detect these areas or pockets that are substantially over the upper limit rod breakout pressure and signal that this portion of the well should be investigated before the rods 838 are run back into the well 58.

Returning to FIG. 10, in step 1028, an evaluation is conducted to determine if the peak hydraulic pressure is above the upper limit or below the lower limit. In one exemplary embodiment, the evaluation is conducted by the computer 605 at the rig 20. Alternatively, the evaluation can be conducted by another computer at the site or an off-site computer. If the peak hydraulic pressure is above the upper limit or below the lower limit, the "YES" branch is followed to step 1030, where an alarm is generated. In certain exemplary embodiments, the alarm can be audible, visual or both. Examples of audible alarms include, but are not limited to, horns, sirens, and whistles. Examples of visual alarms include, but are not limited to flashing lights, activating a light, and messages displayed on the display 610 of the computer 605. In certain exemplary embodiments, the alarm may be activated even when the peak hydraulic pressure is between the upper limit and the lower limit. In these embodiments, different types, pitches or sounds of alarms can be generated based on whether the peak hydraulic pressure is below the lower limit, above the upper limit, or between the upper limit and the lower limit.

The rods 838 being broken apart and/or the peak hydraulic data are examined to determine the cause of the peak hydraulic pressure being out of range. In one exemplary embodiment, the rods 838 are checked for wear and damage to determine if they can be reused. The process continues from step 1032 to step 1034.

Returning to step 1028, if the peak hydraulic pressure is not above the upper limit or below the lower limit, the "NO" branch is followed to step 1034. In step 1034, an inquiry is conducted to determine if there is another rod 838 to pull from the well 58. If so, the "YES" branch is followed back to step 1014. Otherwise, the "NO" branch is followed to step 1036, where the mean and average breakout pressures for the entire pull of rods 838 or the rods 838 of a particular size is calculated. In one exemplary embodiment, the average can be calculated by taking the sum of the peak hydraulic pressure for the breakout of each rod 838 of a particular size and dividing the sum by the number of breakout operations for that size of rod 838. In addition, the mean can be calculated using know techniques with the same information provided above. In one exemplary embodiment, the computer 605 calculates the mean and average, however the mean and average could also be calculated with another computer either on-site or off-site.

In step 1038, the number of rods 838 having a peak hydraulic pressure above the upper limit during the breakout procedure is calculated. In certain exemplary embodiments, the computer 605 can use a counter during the breakout operation and count the number of peaks above the upper limit. In the alternative, the computer 605, after completion of the pull of rods 838, can evaluate the hydraulic pressure data during breakout procedures and count the number of peaks above the upper limit. In step 1040, the number of rods 838 having a peak hydraulic pressure below the lower limit during the breakout procedure is calculated. In certain exemplary embodiments, the computer 605 can use a counter during the breakout operation and count the number of peaks below the lower limit. In the alternative, the computer 605, after completion of the pull of rods 838, can evaluate the hydraulic pressure data during breakout procedures and count the number of peaks below the lower limit. In step 1042, the number of total rods 838 pulled during the pull procedure is calculated and the number of rods 838 by size is calculated. In certain exemplary embodiments, the computer 605 can use a counter during the breakout operation and count the number of peaks of hydraulic pressure during a breakout operation within a pull procedure. In the alternative, the computer 605 after completion of the pull of rods 838, can evaluate the hydraulic pressure data during breakout procedures and count the number of total peaks of hydraulic pressure during a breakout operation within a pull procedure. In addition, since the computer 605 is capable of accepting data related to rod size during the pull operation, the count can also be organized by rod size. The process continues from step 1042 to the END step.

Figure 11:
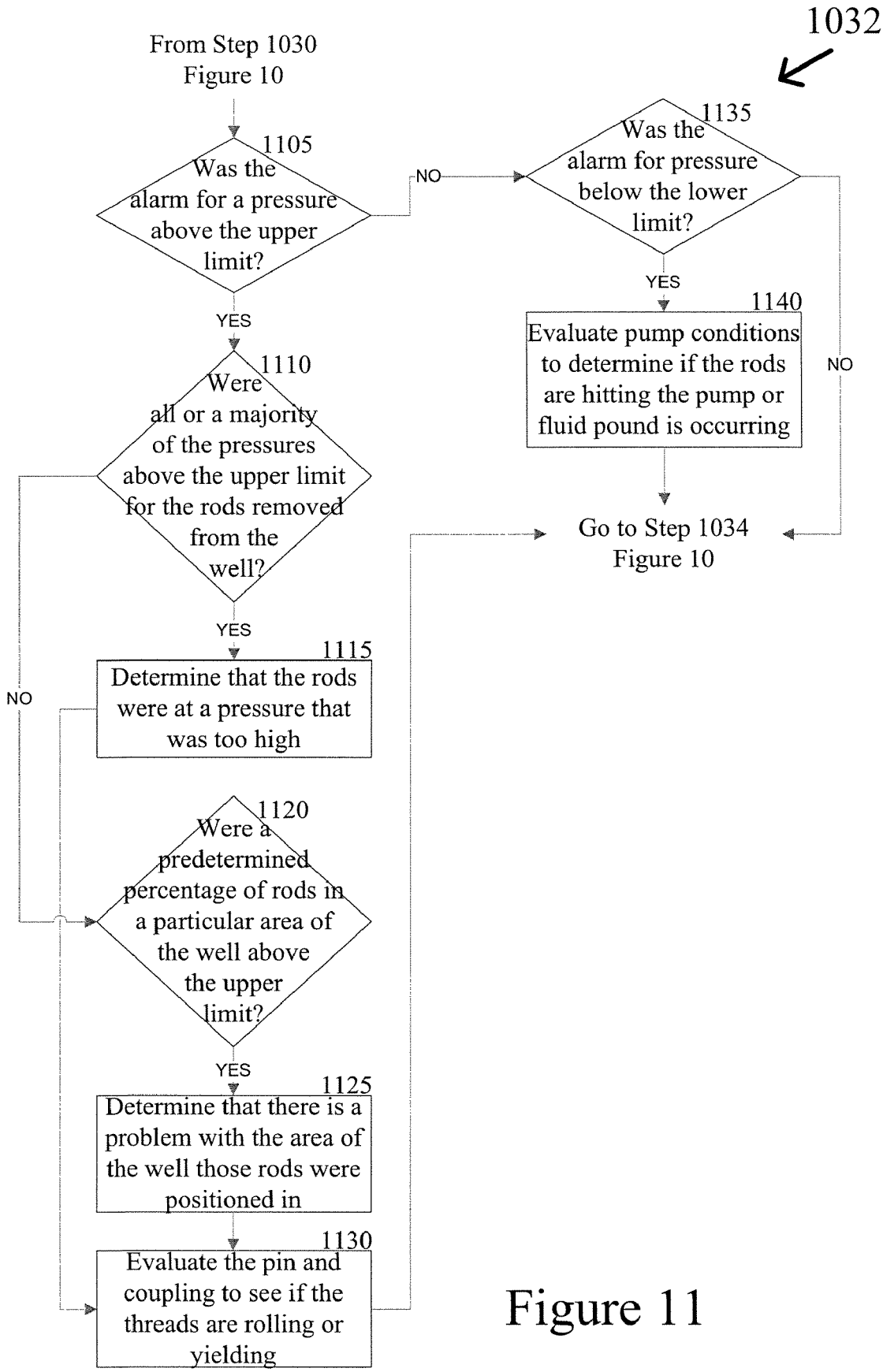
FIG. 11 is a logical flowchart diagram illustrating the steps of an exemplary process for examining rods and pressure data to determine the potential causes of breakout pressure outside of an expected range in accordance with one exemplary embodiment of the present invention.

FIG. 11 is a logical flowchart diagram illustrating an exemplary method for examining rods and pressure data to determine the potential problem causing peak hydraulic breakout pressures above the upper limit or below the lower limit as set forth in step 1032 of FIGS. 10 and 12. Referring now to FIGS. 1, 6, 8, 10, 11, and 12, the exemplary method 1032 begins at step 1105, where an inquiry is conducted to determine if the alarm was generated for a pressure above the upper limit. Those of ordinary skill in the art will recognize that the same operation could be based on an evaluation of the peak hydraulic pressure during a breakout procedure, whether an alarm was generated or not. If the alarm was not for a pressure above the upper limit, the "NO" branch is followed to step 1135. Otherwise, the "YES" branch is followed to step 1110.

In step 1110, an inquiry is conducted to determine if all or a majority of the peak hydraulic pressures during breakout procedures are above the upper limit for rods 838 removed from the well 58 during the pull procedure. In one exemplary embodiment, the determination of a majority can be seventy-five percent and above, however any amount above fifty percent is within the scope of this invention. In certain exemplary embodiments, the evaluation is conducted by the computer 605. If all or a majority of the peak pressures were above the upper limit, the "YES" branch is followed to step 1115, where a determination is made that the rods 838 were made up at a pressure that was above the expected make-up pressure. The process then continues from step 1115 to step 1130.

Returning to the inquiry of step 1110, if all or a majority of the peak hydraulic pressures were not above the upper limit, the "NO" branch is followed to step 1120. In step 1120, an inquiry is conducted to determine if a predetermined percentage of peak hydraulic pressures for rods 838 in a particular area of the well 58 were above the upper limit. For example, during the breakout procedure, the peak hydraulic pressures could generally be within the expected range, below the upper limit but above the lower limit, for most of the rods 838. Along one particular section of the well 58, though, ninety percent of the peak pressures are above the upper limit. Subsequently, almost all of the peak pressures return to within the expected range. These types of pressure readings could signify a problem within the well 58. In one exemplary embodiment, the predetermined percentage can be any amount above sixty percent. If there was not a predetermined percentage above the upper limit, then the "NO" branch is followed to step 1130. Otherwise, the "YES" branch is followed to step 1125, where the computer 605 determines that there is a problem with the area of the well 58 from which those rods 838 were pulled.

The operator or other workers evaluate the pin and coupling 842 for the rod 838 to determine if the threads are rolled or yielding, if there is corrosion on the threads, and if the rod 838 can be reused or needs to be replaced in step 1130. The operator can also use a thread gauge and run the thread gauge around the threads to see if they are rolled. The process continues from step 1130 to step 1034 of FIG. 10 or step 1234 of FIG. 12. In step 1135, an inquiry is conducted to determine if the alarm was for a peak hydraulic pressure that was below the lower limit. As with step 1105, those of ordinary skill in the art will recognize that the same operation could be based on an evaluation of the peak hydraulic pressure during a breakout procedure, whether an alarm was generated or not. If the alarm was not for a pressure below the lower limit, then the "NO" branch is followed to step 1034 of FIG. 10 or 1234 of FIG. 12. Otherwise the "YES" branch is followed to step 1140. In step 1140, a determination is made by the computer 605 that the cause of the low peak pressure may be the rods hitting the pump and or fluid pound within the pump. The operator, or other workers near the rig 20 are instructed to evaluate the pump conditions to determine if the rods are hitting the pump or fluid pound is occurring. The process then continues from step 1140 to step 1034 of FIG. 10 or step 1234 of FIG. 12.

Figure 12:
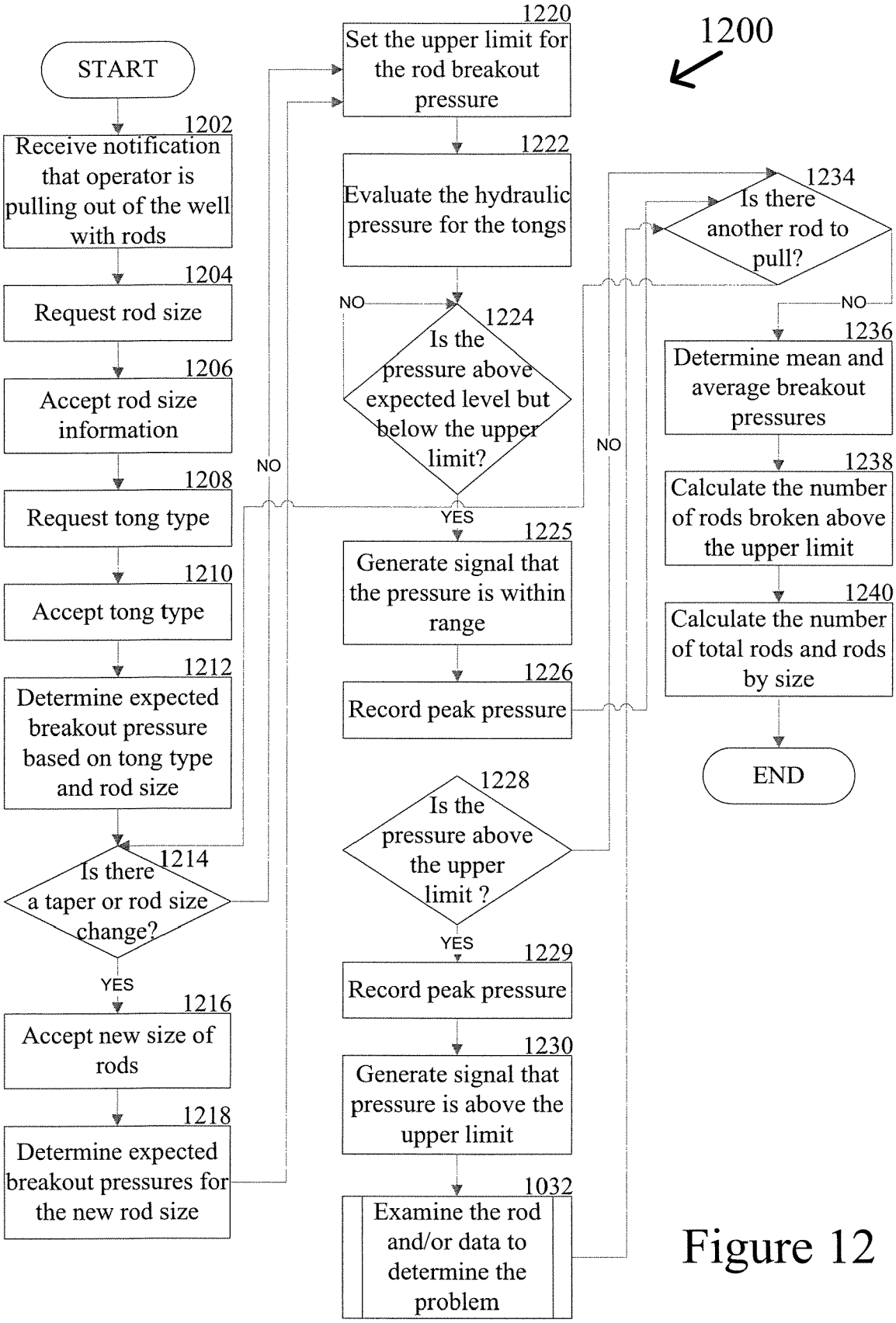
FIG. 12 is a logical flowchart diagram presenting the steps of an alternative process for determining if rods are disassembled at a proper breakout pressure based on an evaluation of tong pressure data in accordance with one exemplary embodiment of the present invention.

Turning now to FIG. 12, a logical flowchart diagram illustrating an alternative method 1200 for determining if rods 838 are disassembled at a proper breakout pressure based on an evaluation of tong pressure data is presented according to one exemplary embodiment of the present invention. Referring to FIGS. 1, 7, 8, and 12, the exemplary method 1200 begins at the START step and continues to step 1202, where notification is received that the operator is pulling out of the wellbore 58 with rods 838. In one exemplary embodiment, the notification is received at the computer 605 by the operator selecting the pull operation 615 on the display 610 either through the use of the keyboard 625, a mouse, or the display 610 being a touch screen display. In step 1204 the rod size is requested. In one exemplary embodiment, the rod size is requested from the operator at the display 610. The rod size information is accepted in step 1206. The rod size information can be input by the operator at the keyboard 625 of the computer 605.

In step 1208, a request is made to provide information describing the tongs 812 used for the current job. In one exemplary embodiment, the request is made by the computer 605 at the display 610. The tong type information is received in step 1210 from the operator at, for example, the computer 605 through the keyboard 625; however, other input devices known in the art of computers could also be used. In step 1212, the expected breakout pressure is determined. In one exemplary embodiment, the expected breakout pressure is determined based on the tong type and the rod size. In certain exemplary embodiments, the expected breakout pressure is based on the pressure needed to properly make-up that particular rod size with that type of tong 812 when the rods 838 are being run into the well 58. In certain exemplary embodiments, the expected breakout pressure is stored within the computer 605 or in a place accessible by the computer 605, such as through the Internet. In an alternative embodiment, the operator can input the expected breakout pressure based on information related to these particular rods 838 being run into the well 58 or based on typical rods 838 and tongs 812 of the type in use for this pull operation.

In step 1214, an inquiry is conducted to determine if there is a taper or rod size change. The change in size can affect the expected breakout pressures and therefore the upper and/or lower pressure limits that need to be monitored. If there is not a rod size or taper change, the "NO" branch is followed to step 1220. On the other hand, if there is a rod size or taper change, the "YES" branch is followed to step 1216, where the new rod size or taper information is accepted. In one exemplary embodiment, the information is input by the operator at the computer 605. In step 1218, the computer 605, operator, or other external entity determines the expected breakout pressures for the new rod size or taper.

In step 1220, the upper limit for the rod breakout pressure is set. In one exemplary embodiment, the upper limit for the rod breakout pressure is a predetermined percentage above the expected rod breakout pressure. The predetermined percentage can be between 10-100 percent above the expected rod breakout pressure. Generally, the predetermined percentage is between 20-25 percent. In an alternative embodiment, the upper limit for the rod breakout pressure is a predetermined fixed amount above the expected rod breakout pressure. In one exemplary embodiment, the predetermined fixed amount is between 50-800 psi above the expected rod breakout pressure. The upper limit can be set by the computer 605 based on input information or it can be set by the operator inputting the upper limit at the computer 605 by way of the keyboard 625.

In step 1222, the computer 605 evaluates the hydraulic pressure for the tongs 812 during the breakout operation. In step 1224, an inquiry is conducted to determine if the hydraulic pressure is above the expected level but below the upper limit. If so, the "YES" branch is followed to step 1225, where a signal is generated that the pressure is within an expected range. In certain exemplary embodiments, the signal can be audible, visual or both. Examples of audible signals include, but are not limited to, horns, sirens, and whistles. Examples of visual signals include, but are not limited to flashing lights, activating a light, and messages displayed on the display 610 of the computer 605. In step 1226 the computer 605 records the peak pressure for the breakout procedure on the rod 838.

Returning to step 1224, if the pressure is not between the expected level and the upper limit, the "NO" branch is followed to step 1228. In step 1228, an inquiry is conducted to determine if the hydraulic pressure is above the upper limit. If the pressure is not above the upper limit, the "NO" branch is followed to step 1234. Otherwise, the "YES" branch is followed to step 1229, where the computer 605 records the peak hydraulic pressure for the breakout operation above the upper limit. A signal is generated that the hydraulic pressure was above the upper limit in step 1230. In certain exemplary embodiments, the signal can be audible, visual or both.

The rods 838 being broken apart or the peak hydraulic data are examined to determine the cause of the peak hydraulic pressure being out of range in step 1032. In one exemplary embodiment, the rods 838 are checked for wear and damage to determine if they can be reused. The process continues from step 1232 to step 1234. In step 1234, an inquiry is conducted to determine if there is another rod 838 to pull from the well 58. If so, the "YES" branch is followed back to step 1214. Otherwise, the "NO" branch is followed to step 1236, where the mean and average breakout pressures for the entire pull of rods 838 or the rods 838 of a particular size is calculated. In one exemplary embodiment, the average can be calculated by taking the sum of the peak hydraulic pressures for the breakout of each rod 838 of a particular size and dividing the sum by the number of breakout operations for that size of rod 838. In addition, the mean can be calculated using know techniques with the same information provided above. In one exemplary embodiment, the computer 605 calculates the mean and average, however the mean and average could also be calculated with another computer either on-site or off-site.

In step 1238, the number of rods 838 having a peak hydraulic pressure above the upper limit during the breakout procedure is calculated. In certain exemplary embodiments, the computer 605 can use a counter during the breakout operation and count the number of peaks above the upper limit. In the alternative, the computer 605, after completion of the pull of rods 838, can evaluate the hydraulic pressure data during breakout procedures and count the number of peaks above the upper limit. In step 1240, the number of total rods 838 pulled during the pull procedure is calculated and the number of rods 838 by size is calculated. In certain exemplary embodiments, the computer 605 can use a counter during the breakout operation and count the number of peaks during a pull procedure. In the alternative, the computer 605 after completion of the pull of rods 838, can evaluate the hydraulic pressure data during breakout procedures and count the number of total peaks. In addition, since the computer 605 is capable of accepting data related to rod size during the pull operation, the count can also be organized by rod size. The process continues from step 1240 to the END step.

Although the invention is described with reference to preferred embodiments, it should be appreciated by those skilled in the art that various modifications are well within the scope of the invention. Therefore, the scope of the invention is to be determined by reference to the claims that follow. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the exemplary embodiments, equivalents of the elements shown therein will suggest themselves to those or ordinary skill in the art, and ways of constructing other embodiments of the present invention will suggest themselves to practitioners of the art. Therefore, the scope of the present invention is to be limited only by any claims that follow.

I claim:

1. A method of evaluating pipe quality based on breakout characteristics as a pipe string is removed from a well, comprising the steps of:

accepting an expected breakout pressure;

accepting an upper limit breakout pressure;

evaluating an actual breakout pressure during a breakout procedure on a pipe in the pipe string; and evaluating the quality of at least a portion of the pipe based on breakout characteristics at least by determining if the actual breakout pressure is above the upper limit breakout pressure.

2. The method of claim 1, further comprising the step of generating an alarm if the actual breakout pressure is above the upper limit breakout pressure.

3. The method of claim 1, further comprising the steps of:

accepting a pipe size representing the size of the pipe to be broken out during the breakout procedure; and determining the expected breakout pressure based on at least the pipe size.

4. The method of claim 1, further comprising the steps of:

evaluating a position of a block, wherein the block assists in raising the pipe string from the well;

determining if the position of the block comprises a breakout position; determining a peak actual breakout pressure while the block is in the breakout position and the block is not moving in a vertical direction; and determining if the peak actual breakout pressure is greater than the upper limit breakout pressure.

5. The method of claim 1, further comprising the steps of:

recording the actual breakout pressure for a plurality of breakout procedures on the pipe string; and determining an average actual breakout pressure.

6. The method of claim 1, further comprising the steps of:

recording the actual breakout pressure for a plurality of breakout procedures on the pipe string; and determining a number of actual breakout pressures above the upper limit breakout pressure.

7. The method of claim 1, further comprising the steps of:

recording the actual breakout pressure for a plurality of breakout procedures on the pipe string; and determining a number of pipe in the pipe string, wherein the determination of the number of pipe is based on a determination of a number of breakout procedures for the pipe string.

8. The method of claim 1, wherein the upper limit breakout pressure is a predetermined percentage of the expected breakout pressure.

9. A computer-readable medium comprising computer-executable instructions for performing the steps required in claim 1.

10. The method of claim 1, further comprising the steps of:

recording the actual breakout pressure as breakout data;

generating a signal to evaluate the pipe based on a positive determination that the actual breakout pressure is above the upper limit breakout pressure;

examining the pipe to determine if the pipe can be reused in the well; and examining the breakout data to determine a cause of the actual breakout pressure being above the upper limit breakout pressure.

11. The method of claim 10, wherein examining the breakout data comprises the steps of:

evaluating the breakout data;

determining if a predetermined percentage of the breakout data is above the upper limit breakout pressure; and generating a signal that the pipe in the pipe string was made-up into the string at a make-up pressure above the expected breakout pressure.

12. The method of claim 10, wherein examining the breakout data comprises the steps of:

evaluating the breakout data;

determining if a predetermined percentage of a predetermined sequential number of actual breakout pressures are below the upper limit breakout pressure;

determining if another predetermined percentage of another predetermined sequential number of actual breakout pressures are above the upper limit breakout pressure; and generating a signal that an area of the well corresponding to a location of a plurality of pipe comprising the other sequential number of actual breakout pressures above the upper limit breakout pressure should be evaluated.

13. A method of evaluating pipe quality based on breakout characteristics as a pipe string is removed from a well, comprising the steps of:

accepting an expected breakout pressure;

accepting an upper limit breakout pressure;

accepting a lower limit breakout pressure;

determining a peak of an actual breakout pressure during a breakout procedure on a pipe in the pipe string;

evaluating the quality of at least a portion of the pipe based on breakout characteristics at least by determining if the peak actual breakout pressure is above the upper limit breakout pressure or below the lower limit breakout pressure; and generating an alarm based on a positive determination that the peak actual breakout pressure is above the upper limit breakout pressure or below the lower limit breakout pressure.

14. The method of claim 13, further comprising the steps of:

receiving an input comprising the size of the pipe to be broken out during the breakout procedure;

determining the expected breakout pressure based on the input;

determining the upper limit breakout pressure based on the expected breakout pressure; and determining the lower limit breakout pressure based on the expected breakout pressure.

15. The method of claim 13, further comprising the steps of:

evaluating a position of a block, wherein the block assists in raising the pipe string from the well;

determining if the position of the block comprises a breakout position; and determining the peak actual breakout pressure while the block is in the breakout position.

16. The method of claim 13, further comprising the steps of:

recording the peak actual breakout pressure for a plurality of breakout procedures on the pipe string; and calculating an average peak actual breakout pressure.

17. The method of claim 13, further comprising the steps of:

recording the peak actual breakout pressure for a plurality of breakout procedures on the pipe string;

determining a number of peak actual breakout pressures above the upper limit breakout pressure; and determining a number of peak actual breakout pressures below the lower limit breakout pressure.

18. The method of claim 13, further comprising the steps of:

recording breakout data comprising the peak actual breakout pressure for a plurality of breakout procedures on the pipe string;

examining the breakout data to determine a cause of the actual breakout pressure being above the upper limit breakout pressure.

19. The method of claim 18, wherein examining the breakout data comprises the steps of:

determining if a predetermined percentage of the breakout data is above the upper limit breakout pressure; and generating a signal that the pipe in the pipe string was made-up into the pipe string at a make-up pressure above the expected breakout pressure.

20. The method of claim 18, wherein examining the breakout data comprises the steps of:

determining if a predetermined percentage of a predetermined sequential number of peak actual breakout pressures are below the upper limit breakout pressure;

determining if another predetermined percentage of another predetermined sequential number of peak actual breakout pressures are above the upper limit breakout pressure; and generating a signal that an area of the well corresponding to a location of a plurality of pipe comprising the other sequential number of peak actual breakout pressures above the upper limit breakout pressure should be evaluated.

21. The method of claim 18, wherein examining the breakout data comprises the steps of:

determining if a predetermined percentage of the peak actual breakout pressures for the pipe string are below the lower limit breakout pressure; and generating a signal to evaluate a pump based on a positive determination that a predetermined percentage of the peak actual breakout pressures for the pipe string are below the lower limit breakout pressure.

22. A method of evaluating rod quality based on breakout characteristics as a string of rods is removed from a well, comprising the steps of:

receiving an input comprising a size of rod to be broken out during the breakout procedure;

determining an upper limit breakout pressure based on the rod size;

determining the lower limit breakout pressure based on the rod size; accepting data comprising a peak of an actual breakout pressure during a breakout procedure on each rod;

determining if the peak actual breakout pressure is above the upper limit breakout pressure or below the lower limit breakout pressure;

generating an alarm based on a positive determination that the peak actual breakout pressure is above the upper limit breakout pressure or below the lower limit breakout pressure; and evaluating the quality of at least a portion of the rod at least by examining the rod to determine if the pipe can be reused in the well.

23. The method of claim 22, further comprising the steps of:

recording breakout data comprising the peak actual breakout pressure for a plurality of breakout procedures on the rods;

examining the breakout data to determine a cause of the actual breakout pressure being above the upper limit breakout pressure.

24. The method of claim 23, wherein examining the breakout data comprises the steps of:

determining if a predetermined percentage of the breakout data is above the upper limit breakout pressure; and generating a signal that the rods were made-up at a make-up pressure above an expected make-up pressure.

25. The method of claim 23, wherein examining the breakout data comprises the steps of:

determining if a predetermined sequential number of peak actual breakout pressures are below the upper limit breakout pressure;

determining if another predetermined sequential number of peak actual breakout pressures are above the upper limit breakout pressure; and generating a signal that an area of the well corresponding to a location of a plurality of rods comprising the sequential number of peak actual breakout pressures above the upper limit breakout pressure should be evaluated.

* * * * *